US010184268B2

(12) United States Patent
Fink et al.

(10) Patent No.: US 10,184,268 B2
(45) Date of Patent: Jan. 22, 2019

(54) SECURITY SWING HANDLE ASSEMBLY

(71) Applicant: FATH, INC., Orlando, FL (US)

(72) Inventors: Armin Fink, Ocoee, FL (US); William Kenneth Williams, Orlando, FL (US)

(73) Assignee: FATH, INC., Orlando, FL (US)

( * ) Notice: Subject to any disclaimer, the term of this patent is extended or adjusted under 35 U.S.C. 154(b) by 382 days.

(21) Appl. No.: 15/050,773

(22) Filed: Feb. 23, 2016

(65) Prior Publication Data

US 2017/0241161 A1 Aug. 24, 2017

(51) Int. Cl.

| | |
|---|---|
| ***E05B 5/00*** | (2006.01) |
| ***E05B 5/02*** | (2006.01) |
| ***E05B 1/00*** | (2006.01) |
| ***E05B 67/38*** | (2006.01) |
| ***E05B 13/00*** | (2006.01) |
| *E05B 17/00* | (2006.01) |

(52) U.S. Cl.

CPC ..... *E05B 5/003* (2013.01); *E05B 1/0053* (2013.01); *E05B 1/0092* (2013.01); *E05B 13/002* (2013.01); *E05B 67/38* (2013.01); *E05B 67/383* (2013.01); *E05B 17/0062* (2013.01)

(58) Field of Classification Search

CPC ..... E05B 5/003; E05B 1/0053; E05B 67/38; E05B 1/003; E05B 13/108; E05B 13/002; E05B 13/10

USPC ..... 70/207–212, 216, 221, 224, 447, 452; 292/336.3, 347, 356, 359, DIG. 30

See application file for complete search history.

(56) References Cited

U.S. PATENT DOCUMENTS

| | | | | |
|---|---|---|---|---|
| 1,619,676 | A | 3/1927 | Meilink | |
| 3,500,668 | A | 3/1970 | Henry | |
| 3,508,423 | A * | 4/1970 | Harrell | E05B 35/08 292/101 |
| 3,889,498 | A | 6/1975 | Harrell | |
| D343,347 | S | 1/1994 | Lau et al. | |
| 5,469,725 | A * | 11/1995 | Yamada | E05B 5/003 292/202 |
| 5,509,700 | A | 4/1996 | Kennedy, Jr. | |
| 5,520,427 | A | 5/1996 | Mader | |
| 5,634,357 | A | 6/1997 | Nutter et al. | |
| D411,433 | S | 6/1999 | Swan et al. | |
| 6,039,363 | A * | 3/2000 | Sugimura | E05O 3/04 292/200 |
| 6,263,712 | B1 | 7/2001 | Ramsauer | |
| 6,298,697 | B1 | 10/2001 | Ramsauer | |
| 6,318,770 | B1 | 11/2001 | Molzer | |

(Continued)

*Primary Examiner* — Suzanne L Barrett

(74) *Attorney, Agent, or Firm* — Robert L. Wolter; Beusse, Wolter, Sanks & Maire PLLC

(57) ABSTRACT

A security swing handle comprises a housing and a handle pivotally mounted to the housing between a closed position and an open position. A locking insert is rotatably supported in the housing and operatively connected to a latch to actuate the latch to release the handle to an open position. A hasp assembly includes a hasp at the bottom of the housing and a plate member disposed within an interior of the housing adjacent to a bottom of the latch. A pin on the locking insert is disposed within an aperture of the plate member to move the plate member against the latch to release the handle to the open position when the locking insert is rotated. If a padlock locked to the hasp is subjected to blunt force, edges of the aperture shear the pin from the locking insert disabling the locking insert.

20 Claims, 9 Drawing Sheets

(56) References Cited

U.S. PATENT DOCUMENTS

| | | | | |
|---|---|---|---|---|
| 6,502,872 | B1 * | 1/2003 | Molzer | E05B 13/106 292/336.3 |
| 6,532,778 | B2 | 3/2003 | Molzer | |
| 6,619,083 | B2 | 9/2003 | Hartel et al. | |
| 7,360,802 | B2 * | 4/2008 | Schlack | E05B 1/0092 292/336.3 |
| 7,665,335 | B2 | 2/2010 | Stuckey | |
| 7,681,424 | B2 | 3/2010 | Antonucci | |
| 8,695,385 | B2 | 4/2014 | Meekma et al. | |
| 9,080,347 | B2 | 7/2015 | Le | |
| 2006/0028027 | A1 * | 2/2006 | Schlack | E05B 1/0092 292/75 |
| 2008/0141742 | A1 | 6/2008 | Stuckey | |
| 2011/0252838 | A1 | 10/2011 | Stuckey | |

* cited by examiner

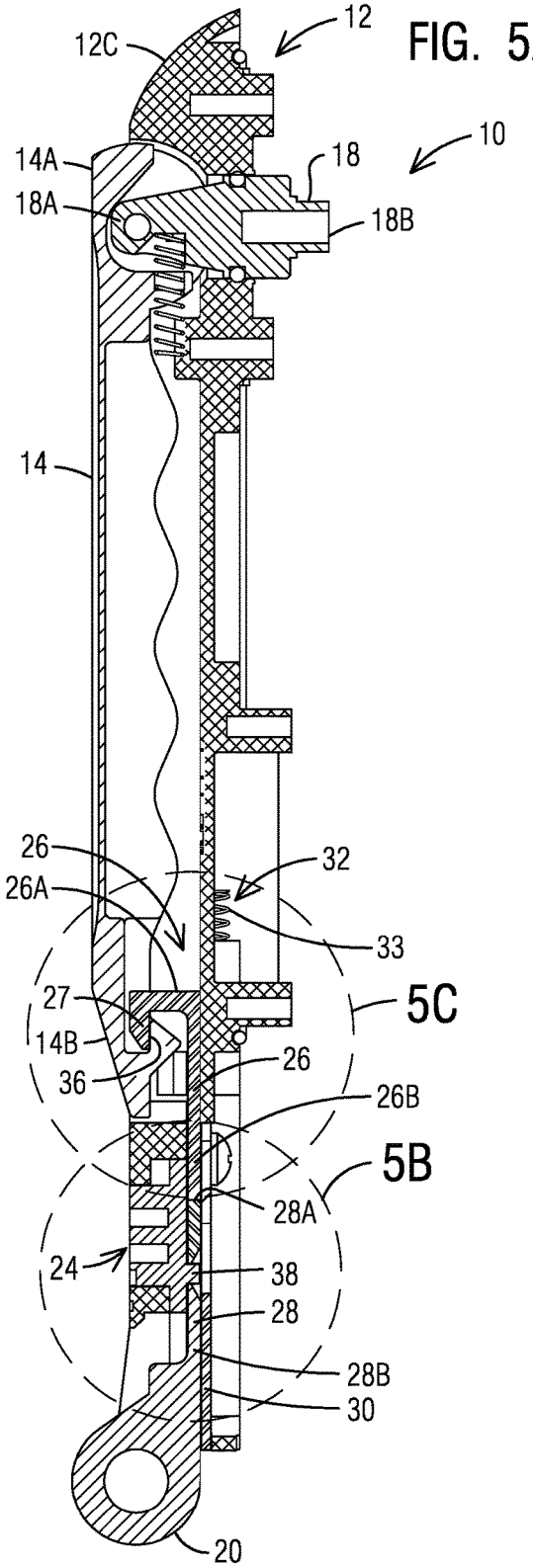
FIG. 5A
FIG. 5B
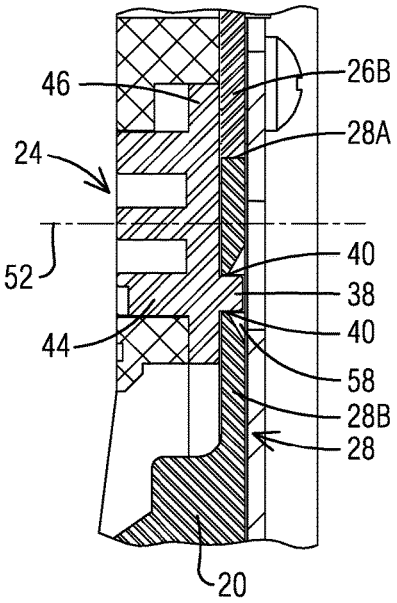
FIG. 5C
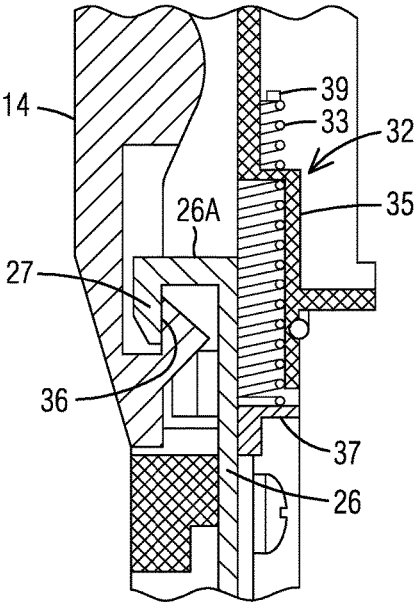

SECURITY SWING HANDLE ASSEMBLY

BACKGROUND OF THE INVENTION

The present invention relates to security handle assemblies and more specifically the invention relates to security handle assemblies having swing handles.

Most of the security swing handle assemblies include a housing mounted to an enclosure door. The housing has a recess over which a swing handle, pivotally mounted to the housing, is retained in a closed position. A hasp mounted in the recess extends through an opening in the handle to receive a padlock for locking the handle in the closed position. In order to open the enclosure door, the padlock is removed and a tool is inserted into a key plug and rotated releasing the handle to an open position. The handle, which is operatively connected to a door latch mechanism in the interior of the cabinet enclosure, is manually pivoted to open the door.

Such security swing handle assemblies are used on electrical enclosure doors of electrical enclosures for cell phone towers. Unfortunately, thieves often break into these electrical enclosures to steal copper wiring which can also result in damage to electrical component in the enclosures. The problem with these existing security swing handle assemblies is that thieves smash the padlock with a large implement to break the padlock from the assembly. In doing so, the hasp and handle are broken so the thieves are then able to access the enclosures. Even if the hasp and handle are not broken from the assembly, the thief will still be able to open the handle by using a tool, which can be found at virtually any hardware store, to insert into the key plug and rotate it to release the handle to the open position. Accordingly, a need exists for a security swing handle assembly that is configured such that if the padlock is broken from the assembly, one is still not able to move the handle to its open position to open an enclosure door.

DESCRIPTION OF THE DRAWINGS

FIG. 5A is a sectional view taken along line 5A-5A of FIG. 3.

FIG. 5B is an enlarged area 5B of FIG. 5A.

FIG. 5C is an enlarged area 5C of FIG. 5A.

DESCRIPTION OF THE INVENTION

Figure 1:
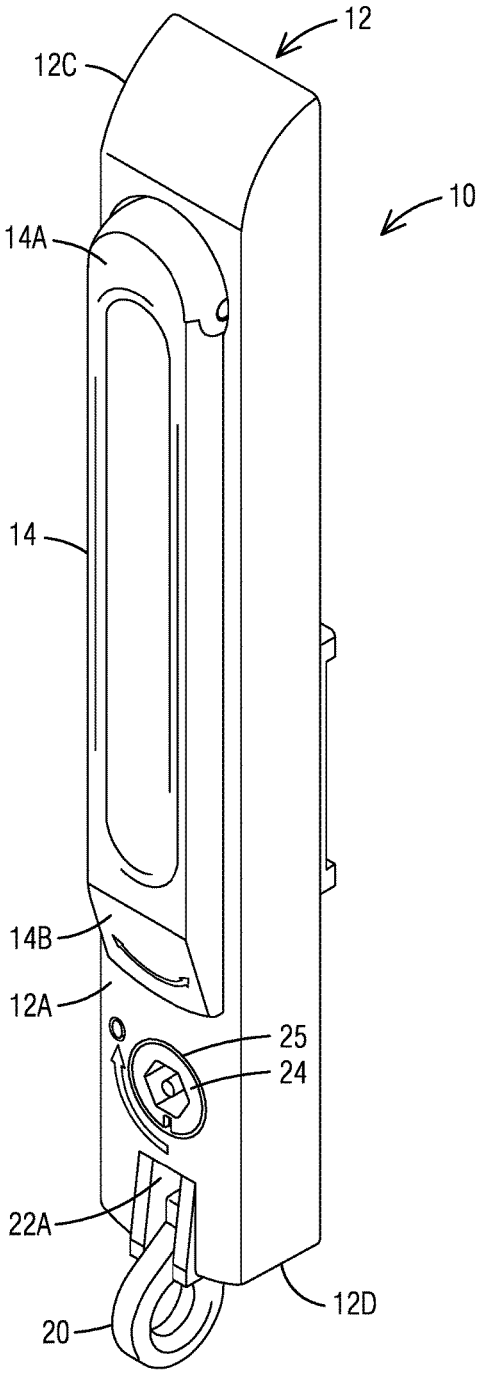
FIG. 1 is a front perspective view of the novel and inventive security swing handle assembly in accordance with aspects of the invention.

For the purposes of promoting an understanding of the principles and operation of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to those skilled in the art to which the invention pertains.

It is important to an understanding of the present invention to note that all technical and scientific terms used herein, unless defined herein, are intended to have the same meaning as commonly understood by one of ordinary skill in the art. The techniques employed herein are also those that are known to one of ordinary skill in the art, unless stated otherwise. For purposes of more clearly facilitating an understanding the invention as disclosed and claimed herein, the preceding definitions are provided. It is further noted that the terms "first," "second," and the like as used herein do not denote any order, quantity, or importance, but rather are used to distinguish one element from another. The terms "a" and "an" do not denote a limitation of quantity, but rather denote the presence of at least one of the referenced item.

Figure 2:
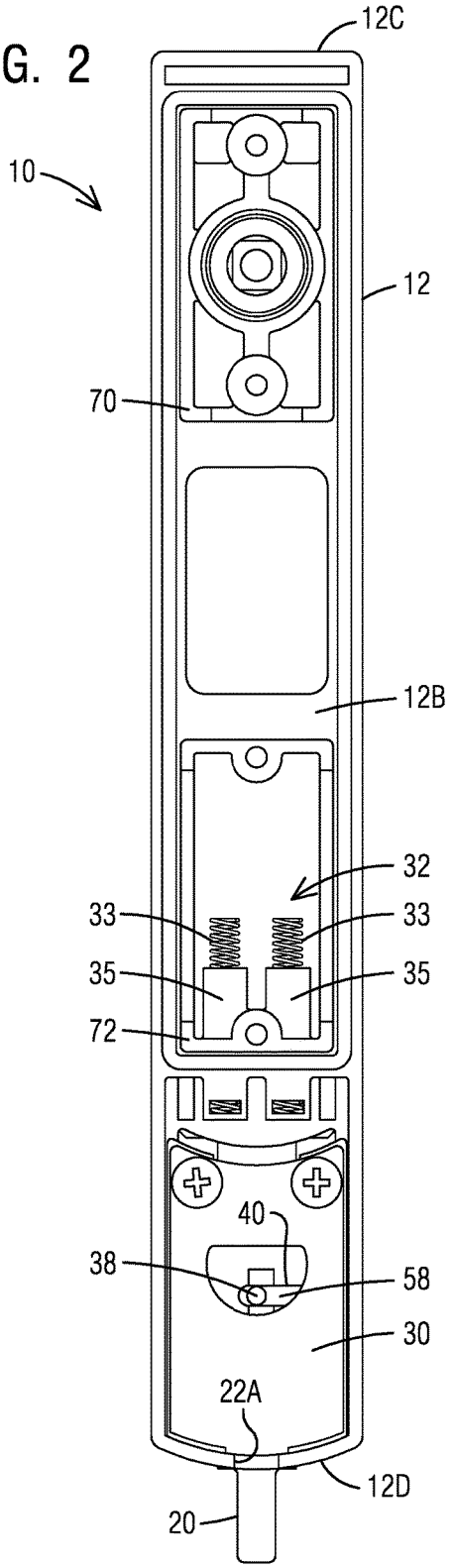
FIG. 2 is a rear elevational view of the security swing handle assembly.
Figure 3:
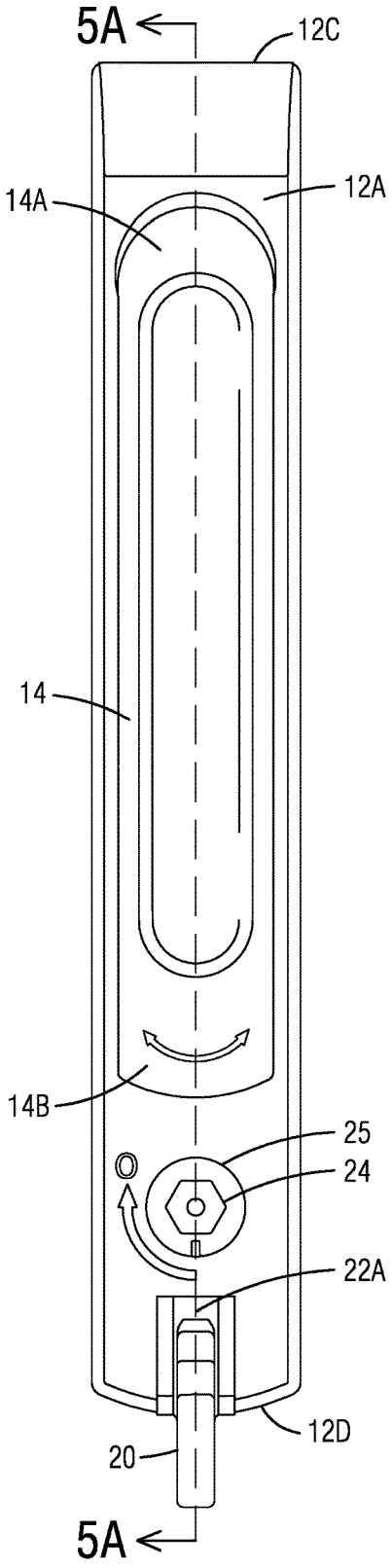
FIG. 3 is a front elevational view of the security swing handle.

With respect to FIGS. 1, 2 and 3 a security swing handle assembly 10 is shown comprising a housing 12 that is mountable on a door, and a handle 14 that is pivotally attached to the housing to move between a closed position and an open position. The handle 14 is also operatively connectable to a door latch mechanism and pivotal laterally relative to the housing 12 to open and close a door. As shown in FIG. 1, the handle 14 is in the closed position. In addition, the assembly 10 includes a locking insert 24 for receiving a tool to release the handle 14 to its open position so the handle 14 may be grasped and rotated or pivoted to open the door (not shown) to which the assembly 10 is mounted.

A locking insert 24 is disposed at an opening 25 (FIG. 4) in the housing 12. The locking insert 24 is configured to receive a tool and, as will be explained in more detail below, is operatively connected to components within the housing 12 to release the handle 14 to its open position when actuated by the tool. In addition, a hasp 20 is disposed at a bottom end of the housing 12 and is configured to receive a padlock 62 (FIGS. 7 and 8) to prevent an unauthorized person from actuating the locking insert 24. In the embodiment shown herein, the locking insert 24 is disposed between the handle 14 and the hasp 20.

Components of the assembly 10 can be seen in more detail in FIGS. 1, 4, 5A, 5B and 5C. The housing 12 has a front side 12A, a back side 12B, a top end 12C and a bottom end 12D. The housing 12 includes a recess 16 in which certain components may be disposed or at least portions of components are disposed. To that end, a first end 14A of the handle 14 is pivotally attached to an actuator 18 toward the top end 12C of the housing 12. The handle 14 is connected to a first end 18A of the actuator 18 that is disposed in the recess 16. The actuator 18 is rotatable within an opening in the recess, and a second end 18B of the actuator 18 is operatively connected to a door latch mechanism as known to those skilled in the art. For example, the actuator 18 may be connected to a gear assembly, which in turn is connected to rods that are actuated to open and close a door. Other actuators may include cam-type actuators.

The handle 14 is held in the closed position by a latch 26, at least a portion of which is disposed in the recess 16. With respect to FIGS. 4 and 5A, the latch 26 includes a hooked top end 26A that is disposed in the recess 16, and the top end 26A is integrally connected with a bottom end 26B that is disposed within an interior volume of the housing 12. A biasing mechanism 32, such as one or more springs 33, is disposed between one or surfaces of the housing 12 and one or more surfaces of the latch 26 to bias the latch 26, or the top end 26A of the latch 26, against a second end 14B of the handle. 14. More specifically, as shown in FIG. 5C the top end 26A of the latch 26 includes a first lip 27 that interfaces with the second lip 36 on the handle 14. Accordingly, the biasing mechanism 32 and latch 26 hold the handle 14 in its closed position covering the recess 16. As shown in FIGS. 2 and 5C, the springs 33 are held under compression between bottoms 37 of retainers 35 and tabs 39 at the top of the springs 33.

Figure 6A:
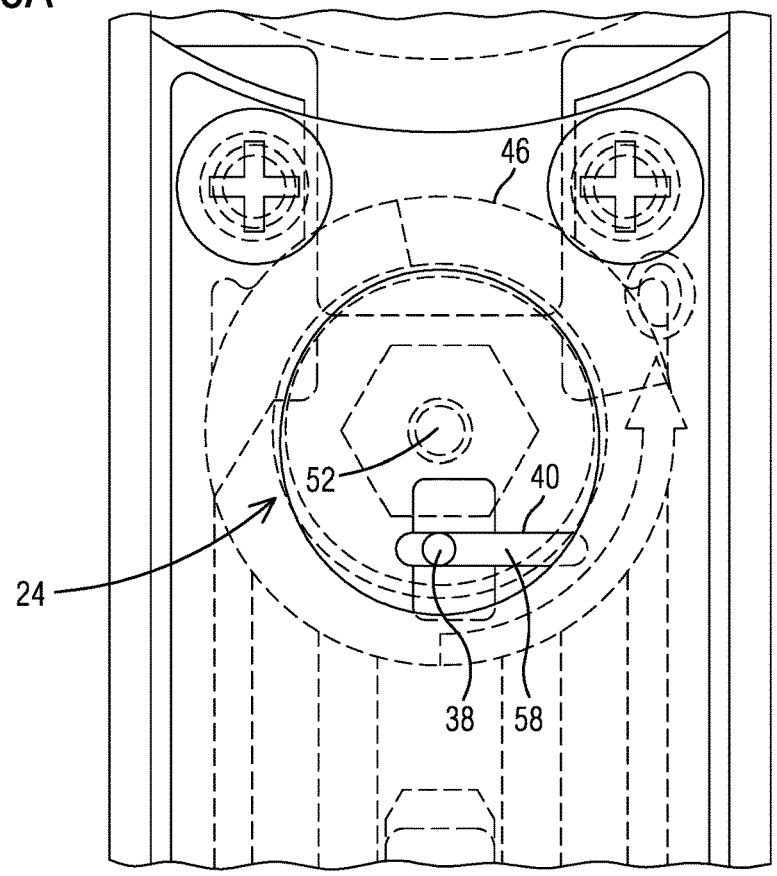
FIG. 6A is an elevational view of a back side of a locking insert in accordance with aspects of the invention.
Figure 6B:
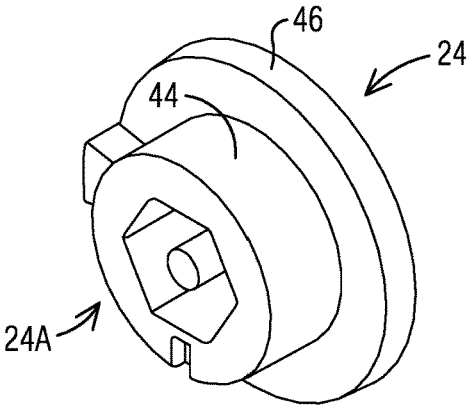
FIG. 6B is a front perspective view of a locking insert in accordance with aspects of the invention.
Figure 6C:
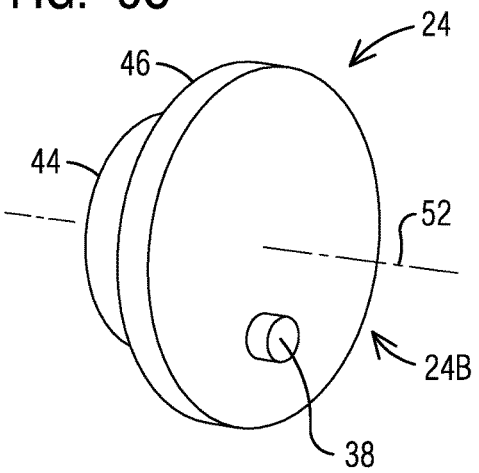
FIG. 6C is a rear perspective view of the locking insert of FIG. 6B.

Again with respect to FIGS. 4, 5A, 5B, and in reference to FIGS. 6B and 6C, the locking insert 24 may comprise a cylindrical body 44, at least a portion of which is disposed and rotatable within opening 25. A first side 24A of the insert 24 faces toward the front side 12A of the housing 12 to receive a key-type tool (see, FIG. 9). As further shown, a pin 38 is disposed on a second side 24B that faces opposite the first side 24A, or toward the backside 12B of the housing 12. As shown in FIGS. 5B, 6A and 6C the pin 38 is eccentrically aligned relative to a central axis 52 of the insert 24, and offset relative to a center of the aperture 58. In this particular embodiment, the pin 38 is disposed on a flange member 46, which is attached to the cylindrical body 44.

The configuration of locking insert 24 to receive the key tool 50 may be any known configuration known to those skilled in the art, such as a hexagonal recess to receive a hex head from a key tool; however the invention is not so limited and may include other geometric shapes or configurations for receiving a corresponding key tool.

Figure 11:
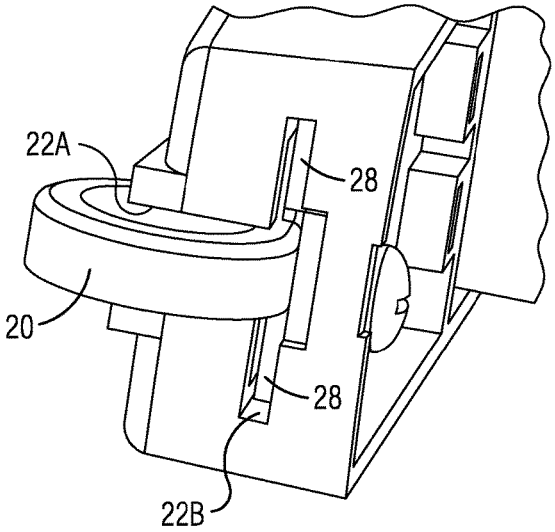
FIG. 11 is a bottom view of the security swing handle assembly.

The locking insert 24 is disposed between the second end 14B of the handle 14 and toward the bottom end 12D of the housing 12. As shown in FIGS. 1, 3 and 5A, the insert 24 is disposed between the second end 14B of the handle 14 and the hasp 20 which is disposed at the bottom end 12D of the housing 12. The hasp 20 is connected to a plate member 28 that is disposed within an interior volume of the housing 12, and the hasp 20, or at least a portion of the hasp 20, is disposed within a slot 22A. In an embodiment and in reference to FIG. 11, the slot may include a first slot 22A along the front side 12A and bottom end 12D of the housing 12, and a second slot 22B on the bottom end 12D of the housing transverse to and intersecting the first slot 22A.

Figure 9:
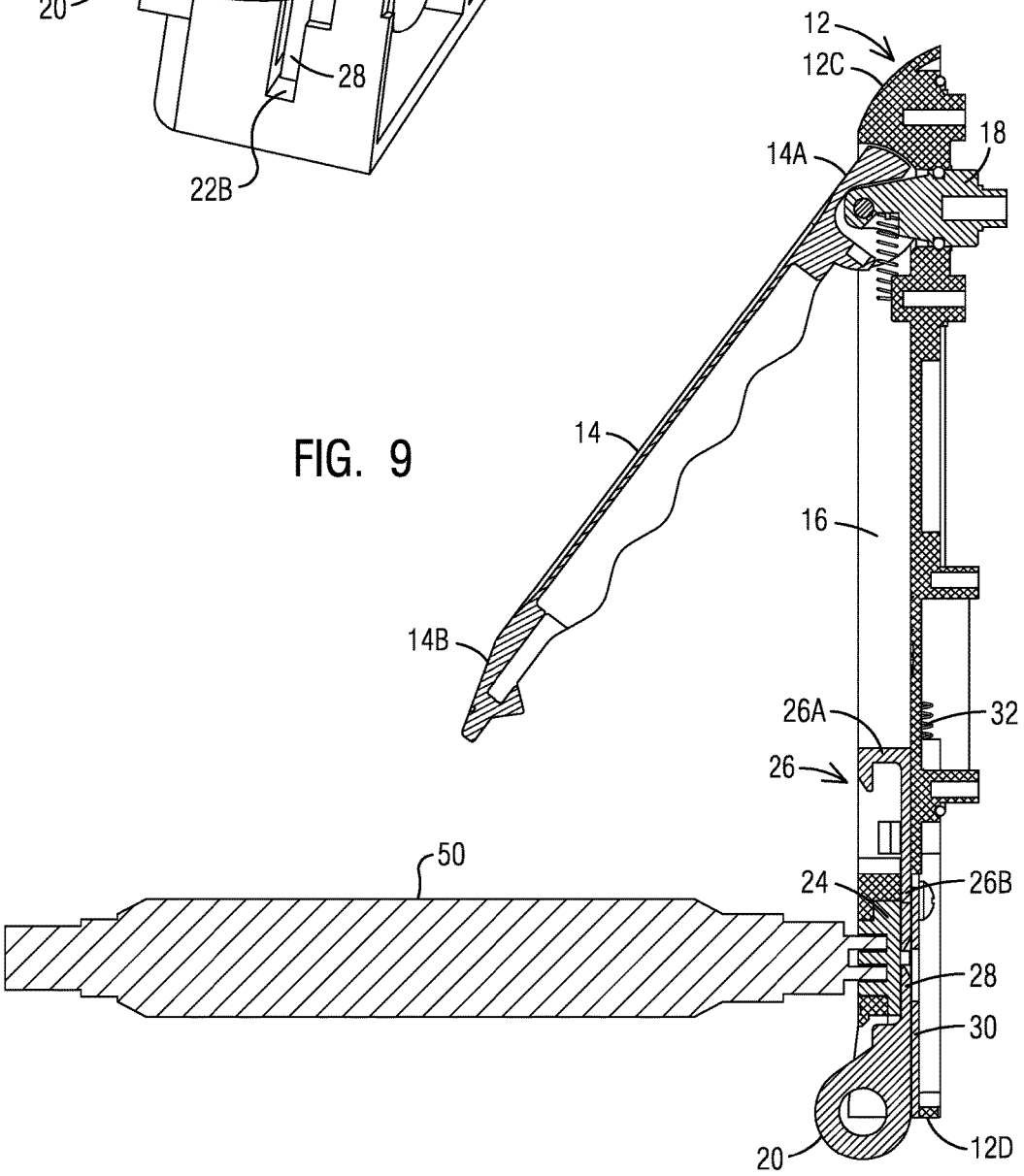
FIG. 9 is a sectional view of the security swing handle assembly with the padlock removed and a tool inserted and rotated to open with the swing handle.

The plate member 28 has a top end 28A that is adjacent to or abuts a bottom end 26B of the latch 26. As further shown in FIGS. 5B and 6A, the pin 38 disposed within an aperture 58 of the plate member 28. Thus, when a key tool 50 engages the locking insert 24 and is rotated, as shown in FIG. 9, the pin 38 engages an edge or edges along the aperture 58 causing the plate member 28 to move upward against the bottom end 26B of the latch 26. This action causes the top end 26A of the latch 26 to move upward thereby releasing the handle 14 to its open position.

The plate member 28 may also include one or more shear edges 40 along aperture 58. The shear edges 40 are sharp enough to remove or break the pin 38 from the locking insert 24. As will be explained, in more detail below this arrangement disables the locking insert 24 in the case of the padlock being hit.

The hasp 20 and plate member 28 together may be referred to as a hasp assembly that includes a hasp connected to a component disposed in the interior of the housing, wherein the top end of the hasp assembly that is in the housing is able to engage the latch. That is, the invention is not limited to this particular embodiment that includes a planar member as plate member 28, but encompasses any configured member.

Figure 4:
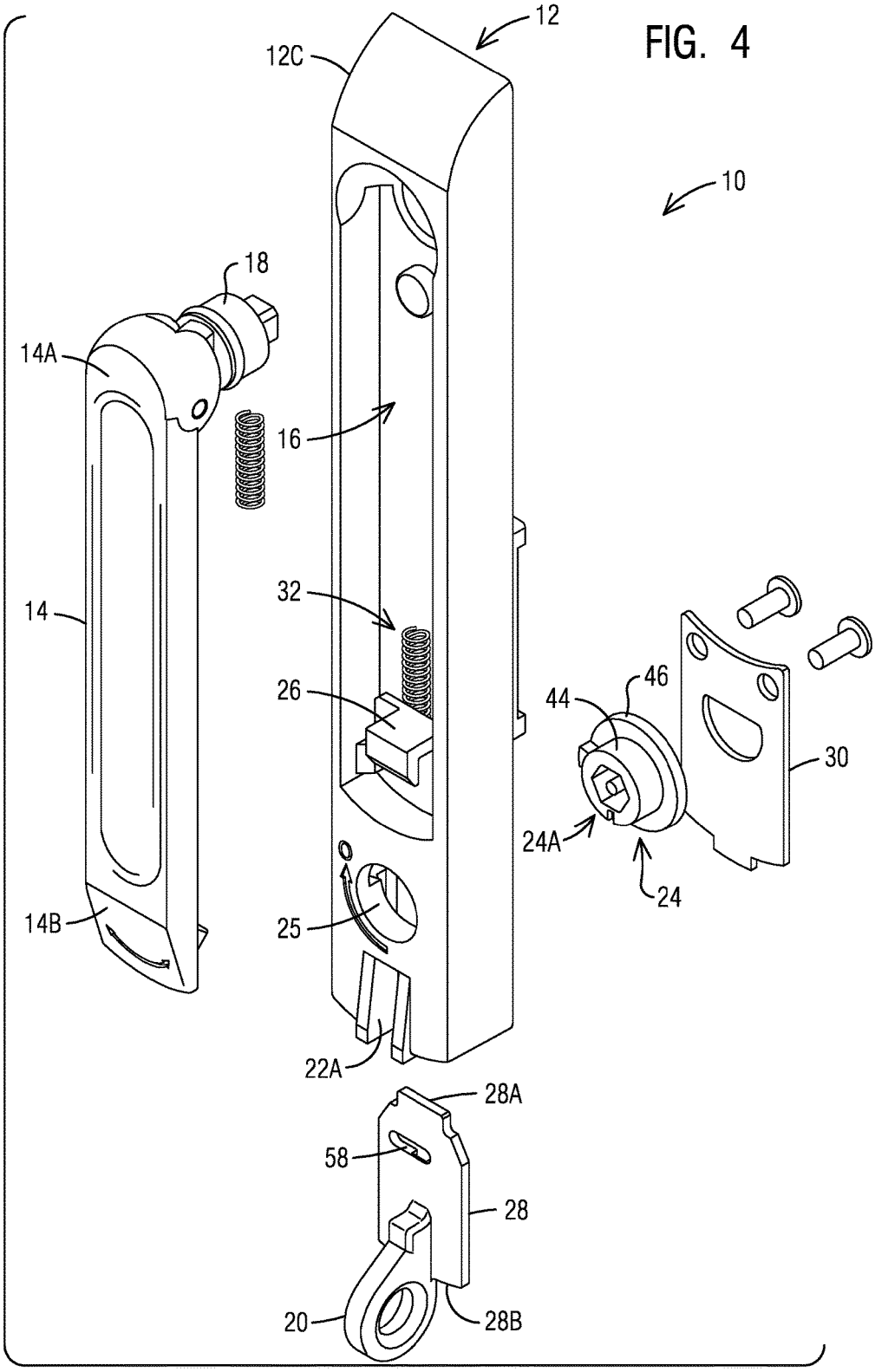
FIG. 4 is an exploded view of the security swing handle.

With respect to FIGS. 1, 2 and 4 a retainer plate 30 is mounted to the back side 12B of the housing 12 and covers at least a portion of the hasp assembly or plate member 28 and the latch 26 to secure those components within the housing 12. As further shown, in FIGS. 2 and 8, bosses 70, 72 are provided including screw or bolt holes to mount the assembly 10 to a door. The boss 72 surrounds an area or volume occupied in part by the biasing mechanism 32. A dust cap 74 may be positioned on boss 72, and the dust cap has apertures aligned with the holes of the boss 72 for attachment to the assembly, between a door and the assembly 10.

Figure 7:
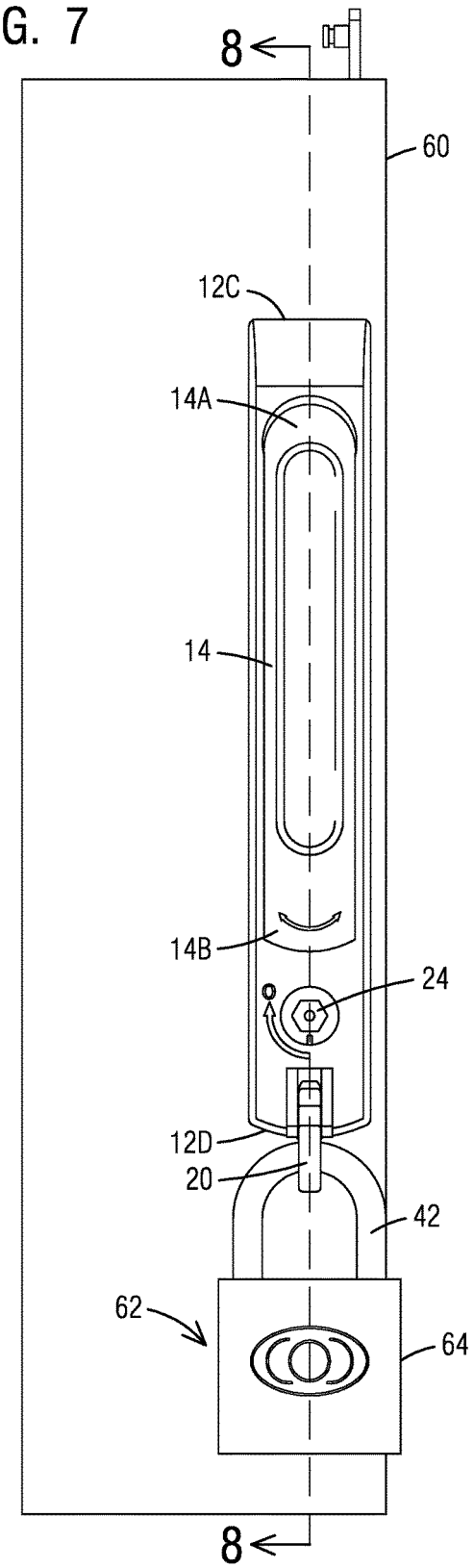
FIG. 7 is a front elevational view of the security swing handle mounted to a door and a padlock connected to the security swing handle assembly.
Figure 8:
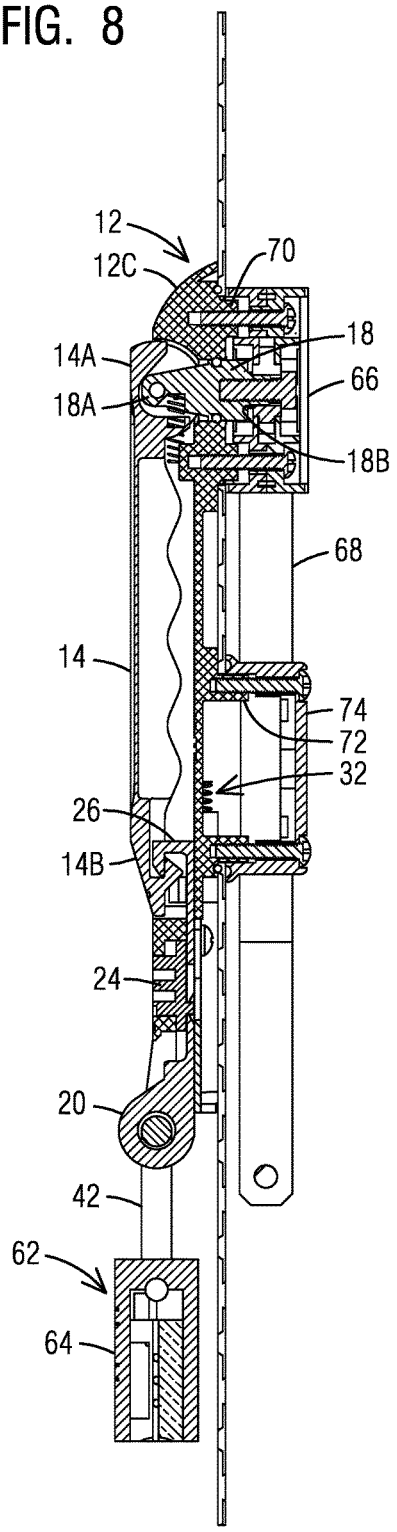
FIG. 8 is a sectional view of the swing handle assembly taken along 8-8 of FIG. 7.

In reference to FIGS. 7 and 8, the security swing handle assembly 10 is shown mounted to an enclosure door 60. A padlock 62, including a shackle 42 and body 64, is locked to the hasp 20. In addition, the actuator 18 is operatively connected to a rod control assembly 66, which is in turn connected to one or more moveable rods 68 to open and close the door 60. In this locked mode, because the hasp 20 is connected to the plate member 28, when the locking insert 24 is rotated the padlock 62 hits the bottom end 12D of the housing preventing sufficient rotation of the insert 24 to move the plate member 28 against the latch 26.

In order to open the enclosure 60, the padlock 62 is unlocked and removed. As shown in FIG. 9, a key tool 50 engages the first side 24A of the locking insert 24 to rotate the insert and move the handle 14 to its open position. Then one can grip the handle 14 and rotate the actuator 18 to move the rods and open the door 60. When the handle 14 is in its open position, the key tool 50 may be removed from the insert 24.

Figure 10A:
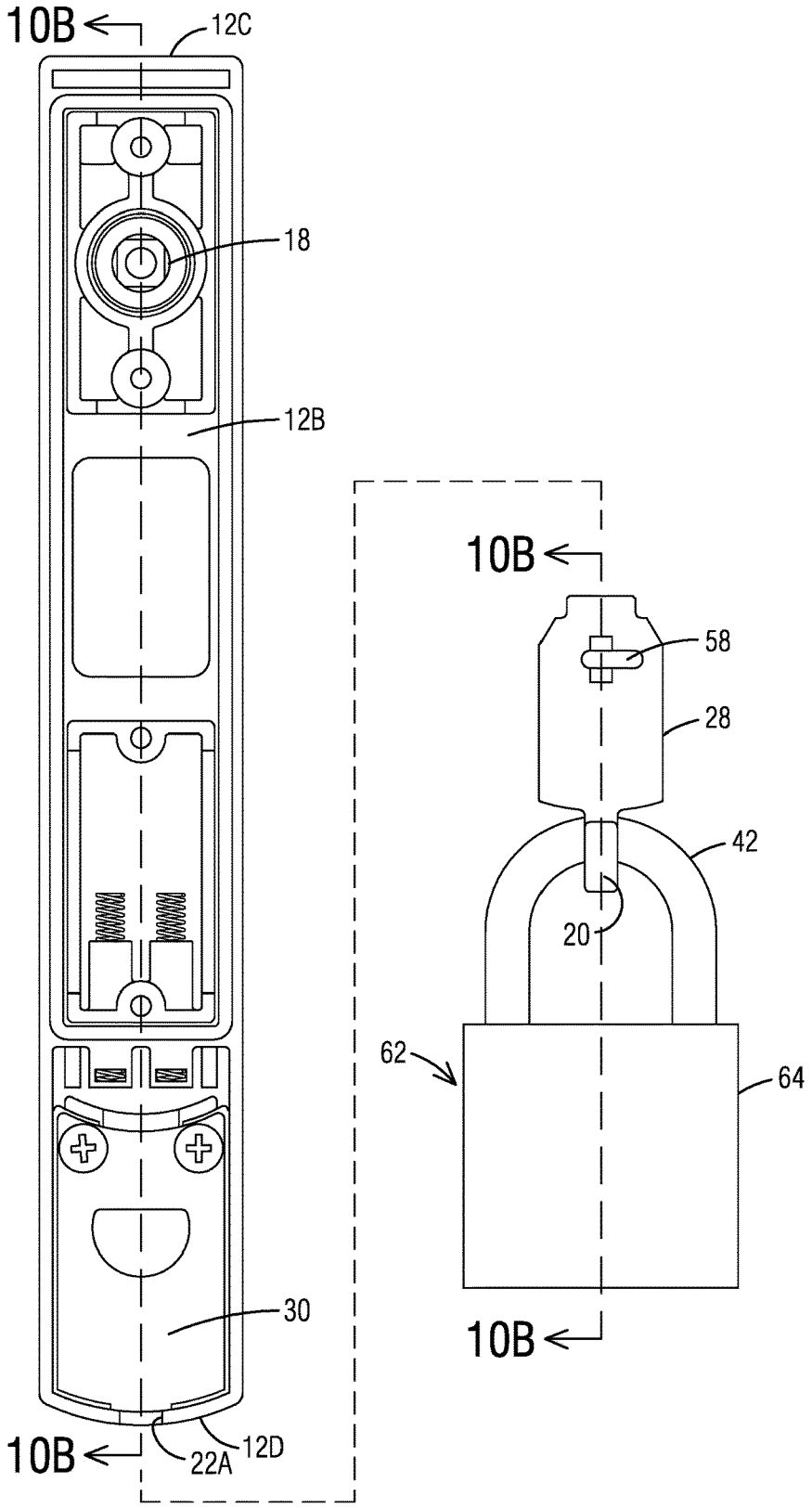
FIG. 10A is a rear elevational view of the security swing handle assembly with the padlock having been broken from the assembly.
Figure 10B:
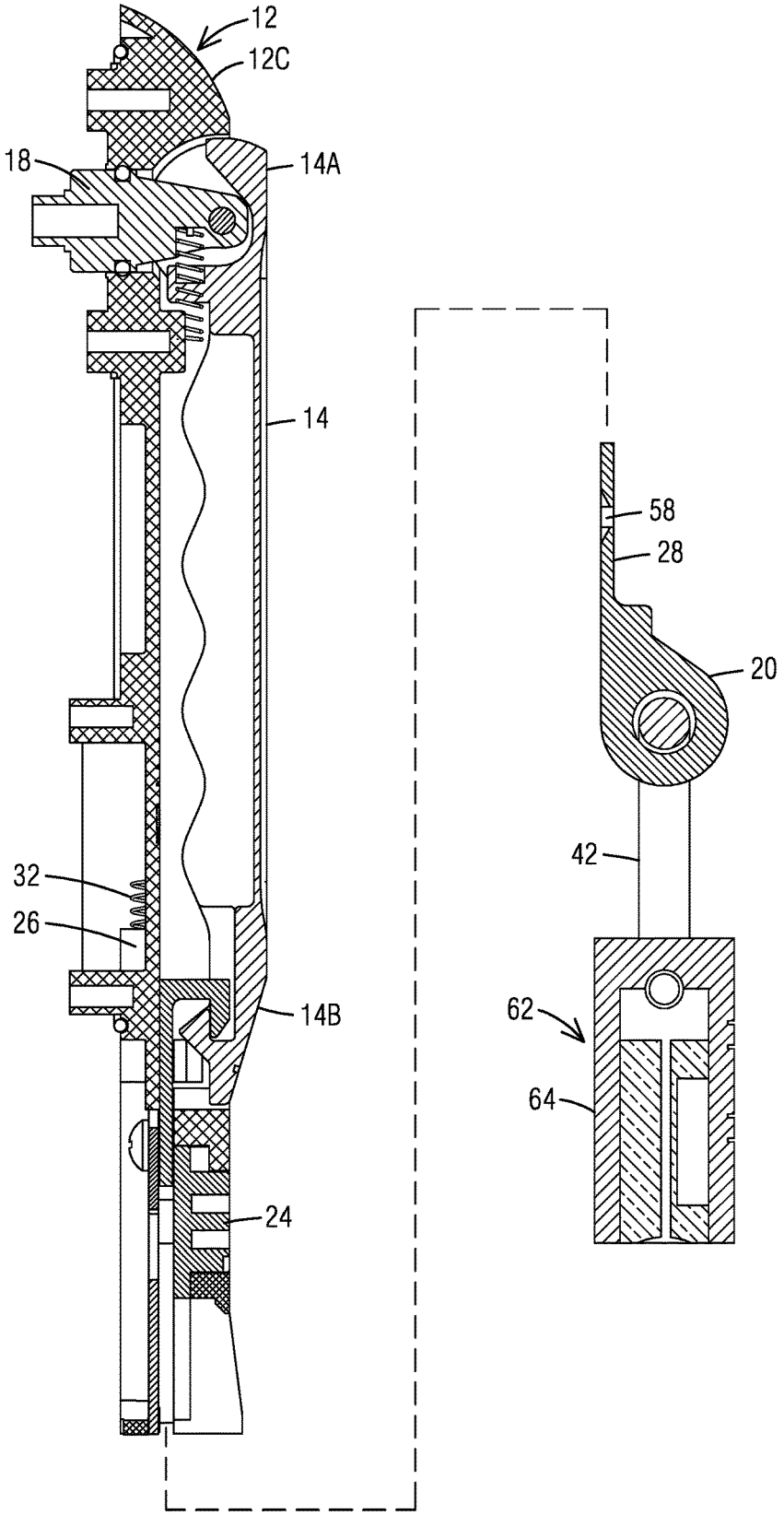
FIG. 10B is a sectional view taken along line 10B-10B of FIG. 10A.

With respect to FIGS. 10A and 10B, a padlock is shown removed from the assembly 10. If one attempts to break into the enclosure (not shown) by breaking the padlock 62, the locking insert 24 may be disabled because the pin 38 will have broken from the insert 24. More specifically, if the padlock 62 is hit with a downward force, for example, the shear edge 40 along the aperture 58 of the plate member 28 will break or remove the pin 38 from the locking insert 24, thereby, disabling the locking insert 24 and preventing any unauthorized entry into the enclosure. To that end, when the pin 38 is broken, the hasp assembly, including the hasp 20 and the plate member 28, may fall through the slots 22A, 22B, further disabling the locking insert 24. Moreover, by positioning the hasp 20 at the bottom end 12B end housing 12 and remotely relative to the handle 14, damage to the handle 14 is avoided to further inhibit unauthorized entry into the enclosure.

Without limiting the invention, the housing 12 may be fabricated, for example, from 30% glass filled black polyamide, and the handle may be fabricated, for example, from a die case zinc or zinc alloy. Metal components of the assembly 10, such as the springs 33, actuator 18, locking insert 24, hasp 20, retainer plate 30, screws, etc. may be fabricated from a passivated stainless steel. However, the invention is not limited to any of these specific materials, and the materials that are durable enough and that can be fabricated to form components that perform the functions of the assembly 10 may be used.

While the preferred embodiments of the present invention have been shown and described herein, it will be obvious that such embodiments are provided by way of example only. Numerous variations, changes and substitutions will occur to those of skill in the art without departing from the invention herein. Non-limiting examples include a component that is described above as being attached to one part of the apparatus may alternatively be attached to a different part of the apparatus in other embodiments. Parts described as being indirectly connected may be connected directly to each other, and vice versa. Component parts may be assembled from individual pieces or may be integrally formed as a single unit. Alternative types of connectors and alternative materials may be used. The apparatus may be used with other types of power tools. Accordingly, it is intended that the invention be limited only by the spirit and scope of the appended claims.

What we claim as the invention is:

1. A security swing handle, comprising:

a housing having a front side, a back side, a top end, a bottom end and a recess between the top end and the bottom end;

a handle having a first end pivotally mounted to the housing toward the top end of the housing, and a second end;

an actuator mounted to the first end of the handle and operatively connectable to a door latch mechanism;

a latch having a top end and a bottom end, wherein the top end is disposed within the recess of the housing and operatively connected to the second end of the handle;

a biasing mechanism disposed within the housing and operatively connected against the housing and the latch biasing the top end of the latch against the second end of the handle thereby retaining the handle in a closed position over the recess of the housing;

a locking insert rotatably supported to the housing having a first side and a second side, wherein the first side faces the front side of the housing and the first side is configured to receive a tool for rotating the locking insert;

a pin on the second side of the locking insert and facing the back side of the housing;

a slot at the bottom end of the housing;

a plate member discrete from the latch, at least a portion of the plate member is disposed within an interior of the housing at the bottom end of the housing, and the plate member has a top end abutting the bottom end of the latch, and the plate member having an aperture in which the pin is disposed;

a hasp connected to the plate member and at least a portion of the hasp is disposed within the slot, and the hasp is configured to the receive a lock, wherein rotation of the locking insert translates the latch, the plate member, and the hasp together as a unit along a common movement axis.

2. The assembly of claim 1 wherein the plate member comprises one or more shear edges along the aperture configured to shear the pin when the hasp and the plate are forced to translate along the common movement axis without a corresponding rotation of the locking insert.

3. The assembly of claim 1 wherein the pin is offset relative to a central axis of the locking insert and when the locking insert is rotated the pin engages an edge of the aperture of the plate member advancing the plate member toward the top end of the housing against the latch and releasing the handle to an open position.

4. The assembly of claim 1 further comprising a retainer plate mounted to the back side of the housing over at least a portion of the latch and at least a portion of the plate member.

5. The handle of claim 1 wherein the locking insert is disposed between the recess and the slot.

6. The assembly of claim 5 wherein the slot includes a first slot along the front side and the bottom end of the housing and a second slot along the bottom end transverse to and intersecting the first slot.

7. A security swing handle assembly, comprising:

a housing having a front side, a back side, a top end, a bottom end and a recess between the top end and the bottom end;

a handle having a first end pivotally mounted toward the top end of the housing, and a second end;

an actuator mounted to the first end of the handle and operatively connectable to a door latch mechanism;

a latch having a top end and a bottom end, wherein the top end is disposed within the recess of the housing and operatively connected to the second end of the handle;

a biasing mechanism disposed within the housing and operatively connected against the housing and the latch, biasing the latch against the handle thereby retaining the handle in a closed position over the recess of the housing;

a locking insert rotatably supported to the housing having a first side and a second side, wherein the first side faces toward the front side of the housing and the first side is configured to receive a tool for rotating the locking insert;

a pin on the second side of the locking insert and the second side faces the back side of the housing;

a plate member within the housing toward the bottom end of the housing, and the plate member has a top end below the bottom end of the latch, and the plate member having an aperture in which the pin is disposed; and, a hasp connected to the plate member, and the hasp has an opening external to the interior of the housing, wherein rotation of the locking insert translates the hasp along a movement axis.

8. The assembly of claim 7 further comprising a lock having a shackle operatively connected to internal components of a body, and the shackle extends through the opening of the hasp.

9. The assembly of claim 7 further comprising a slot at the bottom end of the housing, and the hasp is disposed within the slot.

10. The assembly of claim 7 wherein the plate member has one or more shear edges along the aperture configured to shear the pin when the hasp is forced to translate along the movement axis without a corresponding rotation of the locking insert.

11. The assembly of claim 7 wherein the top end of the latch includes a first lip and the bottom end of the handle includes a second lip, and the biasing mechanism biases the first lip against the second lip to retain the handle in the closed position.

12. The assembly of claim 7 further comprising a retainer plate mounted to the back side of the housing and over at least a portion of the latch and at least a portion of the plate member.

13. The assembly of claim 7 wherein the pin is offset relative to a central axis of locking insert.

14. The handle of claim 7 wherein the locking insert is disposed between the recess and the hasp.

15. The assembly of claim 14 wherein the pin is offset relative to a central axis of the locking insert.

16. A security swing handle assembly, comprising:

a housing having a front side, a back side, a top end, a bottom end and a recess between the top end and the bottom end;

a handle having a first end pivotally mounted toward the top end of the housing, and a second end;

an actuator mounted to the first end of the handle and operatively connectable to a door latch mechanism;

a latch having a top end and a bottom end, wherein the top end is disposed within the recess of the housing and operatively connected to the handle;

a biasing mechanism disposed within the housing and operatively connected against the housing and the latch, biasing the latch against the handle thereby retaining the handle in a closed position over the recess of the housing;

a locking insert rotatably supported to the housing having a first side and a second side, wherein the first side faces toward the front side of the housing and the first side is configured to receive a tool for rotating the locking insert;

a pin on the second side of the locking insert and facing the back side of the housing; and, a hasp assembly include a hasp having an opening, at least a portion of which is external relative to an interior of the housing, and a top end below the bottom end of the latch, and the hasp assembly having an aperture within the interior of the housing and in which the pin is disposed, wherein rotation of the locking insert translates the hasp assembly along a movement axis, and wherein the hasp assembly is configured to shear the pin when the hasp assembly is forced to translate along the movement axis without a corresponding rotation of the locking insert.

17. The assembly of claim 16 wherein the actuator is disposed within the recess of the housing.

18. The assembly of claim 16 further comprising a slot at the bottom end of the housing, and the hasp is disposed within the slot.

19. The assembly of claim 18 wherein the slot includes a first slot along the front side and the bottom end of the housing and a second slot on the bottom end of the housing, and the second slot is transverse to and intersects the first slot.

20. The assembly of claim 16 wherein the hasp assembly comprises one or more shear edges along the aperture configured to shear the pin when the hasp assembly is forced to translate along the movement axis without the corresponding rotation of the locking insert.

* * * * *